United States Patent [19]

Volk

[11] Patent Number: 4,586,432

[45] Date of Patent: May 6, 1986

[54] SETTING MEANS FOR PRINTER WITH PLURAL ENDLESS BANDS

[75] Inventor: Heinrich Volk, Beerfelden, Fed. Rep. of Germany

[73] Assignee: Esselte Pendaflex Corporation, Garden City, N.Y.

[21] Appl. No.: 704,079

[22] Filed: Feb. 21, 1985

[30] Foreign Application Priority Data

Feb. 24, 1984 [DE] Fed. Rep. of Germany ..... 3406791

[51] Int. Cl.[4] ..... B41J 1/20

[52] U.S. Cl. ..... 101/111; 101/105

[58] Field of Search ..... 101/105, 111, 110, 109, 101/288

[56] References Cited

U.S. PATENT DOCUMENTS 4,271,759 6/1981 Volk ..... 101/110

4,325,302 4/1982 Beers ..... 101/288

*Primary Examiner*—Edgar S. Burr

*Assistant Examiner*—Tonya Eckstine

*Attorney, Agent, or Firm*—Gerald J. Ferguson

[57] ABSTRACT

A printing mechanism is described which comprises a plurality of setting wheels (16) mounted coaxially on a sleeve (28). With the setting wheels type bands (20) carrying printing types (22) are in a drive connection. In the sleeve (28) a setting shaft (42) is arranged rototably and axially displaceably. In the sleeve a slot (30) extending in the axial direction is disposed through which a tooth (36) disposed on the setting shaft engages in radial recesses (46) in the hub region of the setting wheels. A detent means comprising detent recesses in the inner region of the sleeve, into which an axially immovable detent element (54) engages, defines axial detent positions of the setting shaft. In the sleeve at least one further slot extending in the axial direction is disposed. The detent recesses are disposed in the inner region of the sleeve in a plurality of axial rows and in each row they have a different detent spacing. The detent element can be brought into any desired fixed association with one of the rows of detent recesses.

4 Claims, 8 Drawing Figures

SETTING MEANS FOR PRINTER WITH PLURAL ENDLESS BANDS

Figure 1:
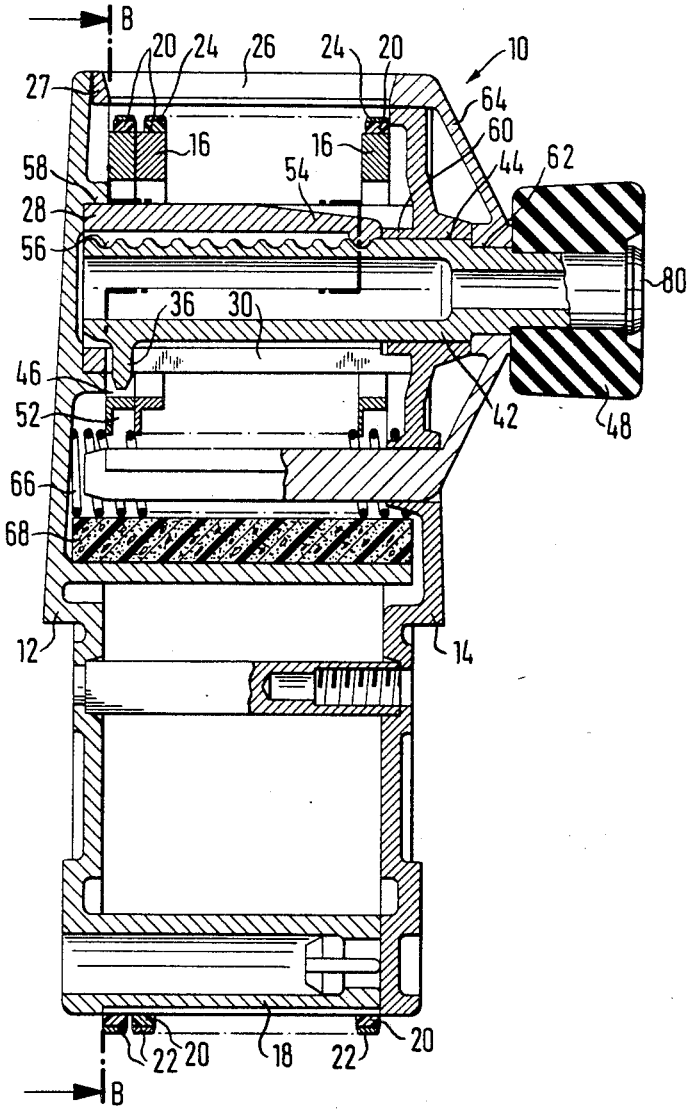

The invention relates to a printing mechanism comprising a plurality of setting wheels which are mounted coaxially on a sleeve and with which type carriers carrying printing types are in a drive connection, a setting shaft disposed rotatably and axially displaceable in the sleeve, a slot extending in the axial direction being formed in the sleeve and through said slot a tooth disposed on the setting shaft engages in radial recesses in the hub region of the setting wheels, and a detent means with detent recesses in the inner region of the sleeve into which for fixing axial detent positions of the setting shaft an axially immovable detent element engages.

Such a printing mechanism is known from DE-GM No. 1,961,550. In this known printing mechanism by axial displacement of the setting shaft the tooth disposed on said shaft can be coupled to any desired setting wheel by engagement in a radial recess in the hub region of the particular setting wheel in such a manner that the setting wheel can be turned by turning of the setting shaft. This permits adjustment of the type carriers in such a manner that desired printing types move into a printing position.

To fix axial detent positions of the setting shaft, i.e. positions in which a drive connection exists between the setting shaft and a setting wheel, a detent means is provided which is fixedly connected to the wall of the printing mechanism housing and which consists of a spring-loaded ball which engages in recesses formed in the setting shaft. On axial displacement of the setting shaft the spring-loaded ball of the detent means drops successively into the recesses of the setting shaft so that the spacing of the recesses is equal to the distance which the setting shaft must cover on axial displacement for the tooth disposed thereon to come out of engagement with a setting wheel and into engagement with the adjacent setting wheel. The recesses in the setting shaft are grooves which surround the setting shaft continuously. This is necessary because the setting shaft turns relatively to the spring-loaded ball but the detent effect must be insured in every rotational position of the setting shaft. Since the intervals of the recesses in the setting shaft depend on the width of the setting wheels said shaft of the known printing mechanism can cooperate only with setting wheels which have a certain width, that is the same width as the intervals of the recesses. If wider setting wheels are to be used so that correspondingly wider type carriers can also be employed another setting shaft must be inserted in which the intervals of the recesses are adapted to the new setting wheel width. The known printing mechanism is thus not flexible as regards its adaptability to setting wheels and type carriers of different widths and various setting shaft types must be kept in stock to permit the use of setting wheels of various widths.

The problem underlying the invention is to further develop a printing mechanism of the type outlined at the beginning in such a manner that it can be adapted to several setting wheel widths whilst maintaining the axial detent action of the setting shaft.

According to the invention this problem is solved in that in the sleeve at least one further slot extending in the axial direction is disposed, that the detent recesses are arranged in the inner region of the sleeve in a plurality of axial rows and have in each row a different detent spacing, and that the detent element is adapted to be brought into any desired fixed association with one of the rows of detent recesses.

Since in the printing mechanism according to the invention in the sleeve at least one further slot extending in the axial direction is provided the setting shaft can be fitted in the sleeve at least in two different positions. Since the tooth disposed on the setting shaft engages through a slot in the sleeve the selected relative position of the setting shaft to the sleeve is retained and on rotation of the setting shaft the sleeve turns correspondingly. The detent element can be fixedly associated with one of the rows of detent recesses in the setting shaft so that due to the different detent spacings of the detent recesses axial detent positions of the setting shaft which are at different intervals can be achieved. The different intervals permit the use of setting wheels of different widths with which accordingly type carriers of different width can also be employed. This shows that with one and the same setting shaft setting wheels of different widths can be used.

Advantageous further developments of the invention are characterized in the subsidiary claims.

Figure 2:
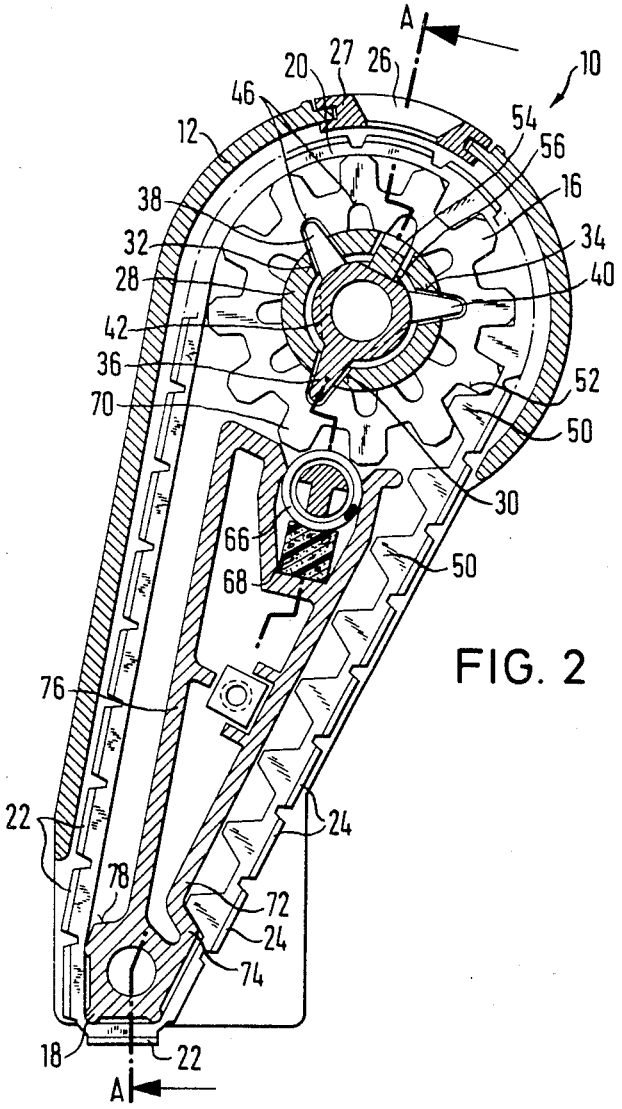
Figure 3:
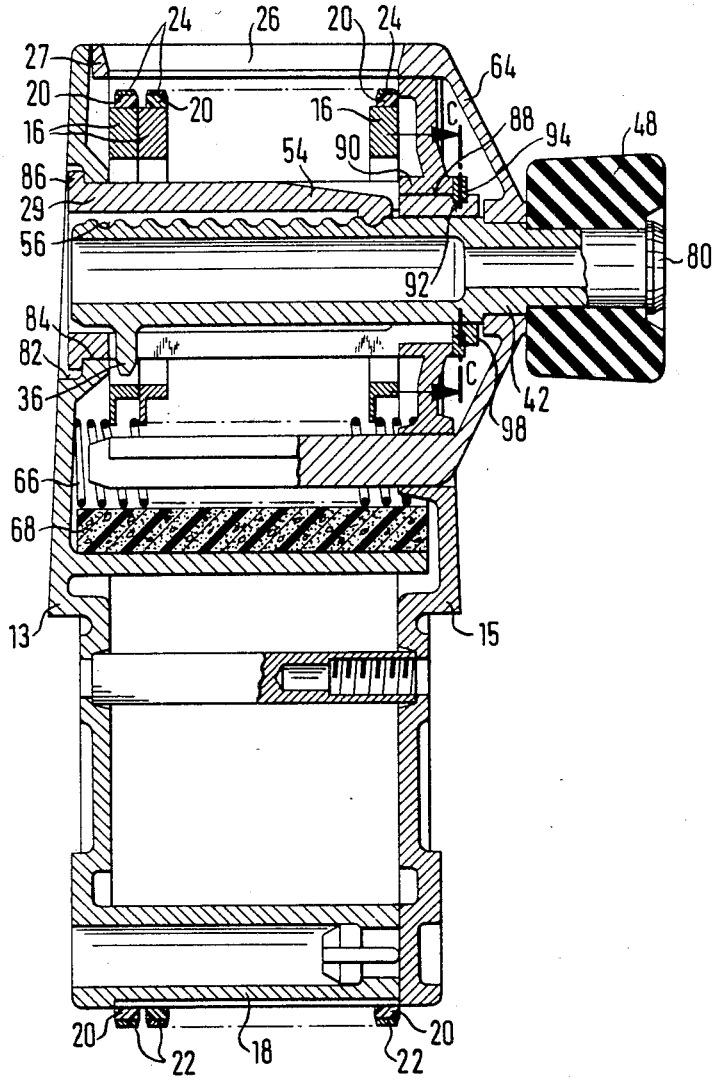
Figure 4:
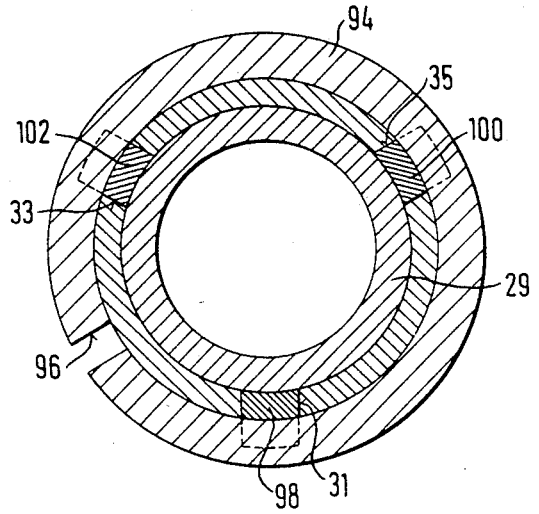
Figure 5:
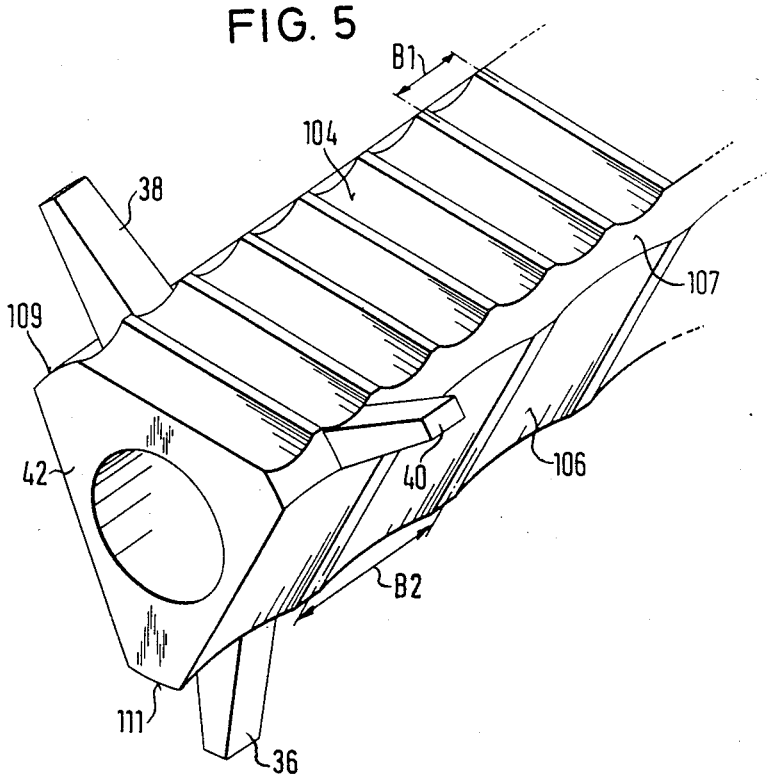
Figure 6:
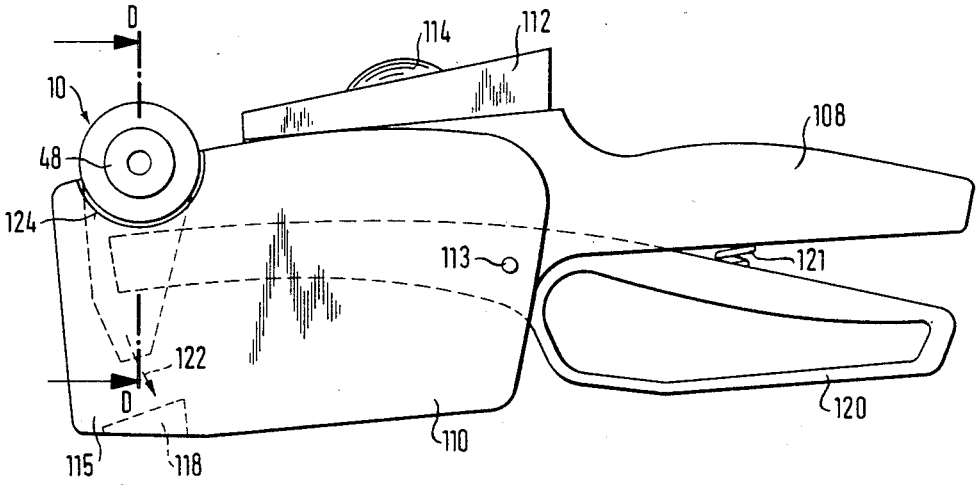
Figure 7:
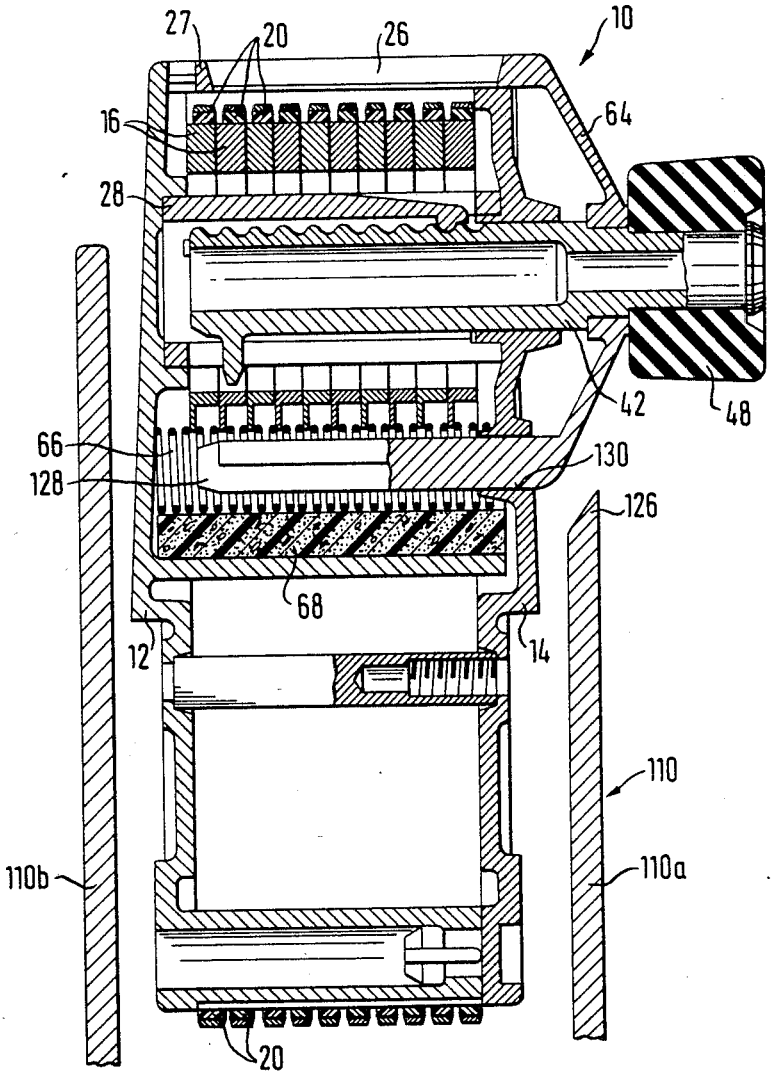
Figure 8:
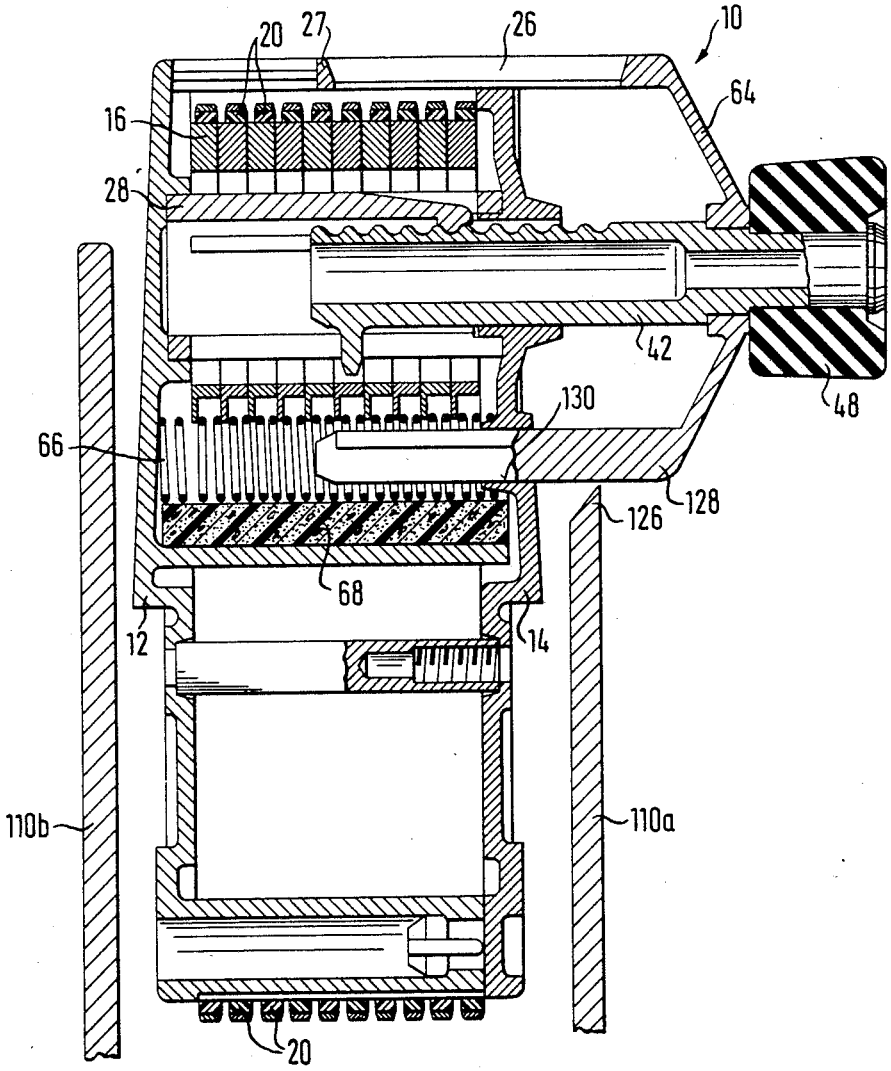

Examples of embodiment of the invention will now be described with reference to the drawings, wherein:

FIG. 1 shows the printing mechanism according to the invention in a section along the line A—A of FIG. 2, FIG. 2 shows the printing mechanism of FIG. 1 in a section along the line B—B of FIG. 1, FIG. 3 shows a second embodiment of the printing mechanism according to the invention in a section similar to that of FIG. 1, FIG. 4 shows a section along the line C—C of FIG. 3, FIG. 5 is a perspective fragmentary view of an embodiment of the setting shaft, FIG. 6 is a schematic side elevation of a labeling device in which the printing mechansim 10 according to the invention can be used, FIG. 7 is a sectional view along the line D—D of FIG. 6 and FIG. 8 is a sectional view like FIG. 7 with the setting shaft pulled further out.

The printing mechanism 10 illustrated in FIG. 1 comprises a printing mechanism housing which is made up of two housing halves 12 and 14 and in which a plurality of parallel adjacent printing bands 20 led round setting wheels 16 and a deflection edge 18 are accommodated. The printing bands 20 carry on one half of their outer peripheral surface printing types 22 and on the other half indicator types 24. The association of the printing types 22 to the indicator types 24 is such that the particular printing types 22 disposed in the printing position at the deflection edge 18 as in FIG. 2 and the particular indicator types 24 visible through a window 26 disposed at the housing upper side represent the same number, the same letter or the like. This means that it can always be seen through the window 26 at the housing upper side which characters can be printed on a record carrier with the printing types 22 disposed at the bottom at the deflection edge.

As already mentioned the printing bands or tapes 20 are led round setting wheels 16 which are rotatably mounted on a sleeve 28. The sectional view of FIG. 2 shows that in the sleeve 28 three slots 30, 32 and 34 are disposed which are open at a sleeve end lying on the right in FIG. 1. Through said slots three teeth 36, 38 and 40 disposed on a setting shaft 42 engage. The setting shaft 42 is axially displaceable in a bearing passage 44 in the housing half 14. By displacement of the setting shaft 42 in the axial direction said shaft can be brought into drive connection with the setting wheels 16 by engagement of the teeth 36, 38 and 40 in recesses 46 in the hub regions of said wheels. At the end of the setting shaft 42 projecting from the housing an actuating knob 48 is disposed with the aid of which the shaft can firstly be axially displaced and secondly rotated. By the axial displacement of the setting shaft 42 the teeth 36, 38 and 40 disposed thereon are first brought into engagement with the recesses 46 of a setting wheel 16 to be adjusted and by rotating the setting shaft 42 the printing band 20 led round the outer periphery thereof is moved until a desired printing type 22 is in the printing position beneath the deflection edge 18. As already mentioned the particular position of the printing types 22 can be checked through the window 26 disposed at the top of the housing. To establish a drive connection between the printing bands 20 and the setting wheels 16 the printing bands 20 comprise at their inner surface teeth 50 which engage in recesses 52 in the outer peripheral surfaces of the setting wheels 16.

To obtain an exact alignment of the plane of the teeth 36, 38 and 40 with the plane of the particular setting wheel 16 to be adjusted a detent mechanism is provided which insures that the setting shaft on axial adjustment thereof always engages in a manner clearly felt by the operator in positions in which a clear drive connection with a setting wheel 16 to be adjusted is established. This detent mechanism comprises a detent finger 54 integrally formed on the sleeve 28, said finger projecting radially inwardly at the sleeve inner surface and engaging in detent recesses 56 which are disposed in a region of the outer peripheral surface of the setting shaft 42. A detent recess 56 is provided for each of the setting wheels 16 mounted on the sleeve 28. If in the arrangement of the individual parts illustrated in FIG. 1 in which the setting shaft 42 is in engagement with the setting wheel 16 on the extreme left the setting shaft 42 is moved to the right so that it comes into engagement for example with the next setting wheel 16 firstly the detent force exerted by the detent finger 54 on the setting shaft 42 must be overcome when it is moved out of the associated detent recess 56 upwardly in the illustration of FIG. 1; it can then drop into the next detent recess 56 which happens exactly when the setting shaft 42 is in engagement with the second setting wheel 16 from the left.

Since the slit sleeve 28 serves as bearing axle for the setting wheels 16 its mounting and arrangement in the printing mechanism must be given particular attention. Firstly, for mounting of the setting wheels 16 the sleeve 28 must have as constant an external diameter as possible and secondly it must also have an exactly defined internal diameter so that the setting shaft 42 can be easily axially displaced without jamming. The sleeve 28 is accommodated on one side, on the left in FIG. 1, in a circular cylindrical recess 58. Since the slits 30, 32 and 34 do not pass through at this side of the sleeve 28 at this point the mounting of the sleeve 28 at its outside is adequate. On the other side, the side on the right in FIG. 1, the three sleeve segments formed by the through slots 30, 32 and 34 are mounted on a hub 60 which is formed on the housing part 14. The hub 60 insures that the sleeve 28 in spite of the through slots has the necessary stability at the associated end for mounting the setting wheels 16. The hub 60 keeps the slots spread apart so that the teeth 36, 38 and 40 can be moved along the slots easily without jamming.

As apparent from FIG. 1 the setting shaft 42 extends in the portion directly adjoining the actuating knob 48 through a bushing 62 which is disposed at a conical cap 64. This cap has inter alia the function of insuring a smooth covering of the upper part of the printing mechanism 10. However, it also carries the frame 27 surrounding the window 26 and displaceably mounted at the top of the housing; the nature of the mounting is clearly apparent from FIG. 2. When the setting shaft 42 is axially displaced the frame 27 with the window 26 also moves, the left end of the inspection window in FIG. 1 lying precisely in the plane of the setting wheel 16 with which the setting shaft 42 is in engagement and which consequently can be adjusted. By observing the left end of the window 26 the operator thus knows in any axial position of the setting shaft 42 which printing band can be brought into the desired position.

To insure that on rotating the certain wheels and the setting of the printing bands thus made the operator performs the individual adjustment operations always until a printing type 22 is exactly in the printing position at the deflection edge 18, a further detent mechanism is provided which facilitates the exact adjustment for the operator. This detent mechanism consists of a helical spring 66 which is disposed parallel to the longitudinal axis of the setting shaft 42 at the periphery of the setting wheels 16 in such a manner that it partially penetrates into the recesses 52 at the periphery of the setting wheels 16, as clearly apparent in FIG. 2. To enable the setting wheels 16 to be turned in spite of the engagement of the helical spring 66 in their recesses in accordance with FIG. 2 the helical spring 66 is mounted on a resiliently yieldable cushion 68. On turning of the setting wheels 16 the helical spring 66 can thus yield and embed itself in the cushion 68. The operator therefore feels on turning the setting wheels from the position illustrated in FIG. 2 into the position in which a tooth 70 is moved between the recesses 52 towards the helical spring 66 firstly an increase of the turning force to be applied, which then again decreases when the helical spring engages in the next recess 52. The operator thus feels clear force peaks and knows that whenever he has overcome a force peak a printing type 22 is in the exact printing position beneath the deflection edge 18.

As already mentioned, at the outer periphery of the printing bands 20 in a longitudinal portion printing types 22 are disposed and in another longitudinal portion indicator types 24. When using the printing mechanism the printing types are first inked before each printing operation, whereupon the ink printing types are then brought into contact with the medium to be imprinted. Through the window 26 it can be seen from the indicator types 24 which characters can be printed on the medium to be imprinted in the particular setting of the printing bands. When operating the printing mechanism it must be avoided that the indicator types 24 during adjustment of the printing bands come into a position beneath the deflection edge 18 in which they could come into contact with the inking mechanism used to ink the printing types. The legibility of the indicator types 24 in the window 26 would be greatly impaired by such an undesired inking. It must therefore be insured that the printing bands 20 can only be moved to such an extent that although all the printing types 22 can be brought into the printing position beneath the deflection edge 18 the associated indicator types 24 cannot be brought into said position. The means for preventing the complete turning of the printing bands 20 comprise the teeth 50 which are disposed on a part of the inner peripheral surface of the printing bands 20 and which are also used for driving the printing bands 20 by engagement in the recesses 52 in the setting wheels 16. As apparent from the sectional view of FIG. 2 the housing comprises in the region within the printing bands 20 a web 72 which extends parallel to the printing bands 20 and which is disposed at such a distance from the printing bands that the teeth 50 can move along it unobstructed. At the end lying adjacent the deflection edge 18 the web 72 comprises however a stop shoulder 74 which is so formed that the leading tooth 50 in the direction of movement strikes over its full height against said stop shoulder 74 when it reaches the region of the deflection edge 18. This stop shoulder 74 prevents the region of the outer peripheral surface of the printing bands 20 which carries the indicator types 24 moving into the printing position beneath the stop edge 18. As apparent from FIG. 2 the indicator types 24 are in the region of the outer peripheral surface of the printing bands 20 in which the teeth 50 are disposed on the inner peripheral surface. The web 72 and the stop shoulder 74 limit the rotation of the printing bands 20 in the illustration of FIG. 2 in the clockwise direction, a limit position which the printing bands 20 can reach being illustrated in FIG. 2. To limit the rotation of the printing bands 20 in the other direction, i.e. anticlockwise in FIG. 2, a second web 76 is disposed on the housing which also has a stop shoulder 78 adjacent the guide edge 18. Said stop shoulder 78 prevents rotation of the printing bands 20 beyond a limit position which is attained when the leading tooth 50 on rotation in the anticlockwise direction meets the stop shoulder 78.

Since the printing bands 20 and the teeth 50 at their inner surface are made from deformable material by applying an excessive force on turning the setting shaft 42 the printing bands 20 could be moved possibly with deformation of the teeth 50 beyond the limit positions defined on either side of the deflection edge 18 and this would have the undesirable result of the indicator types coming into contact with the printing ink. To prevent this undesired "overrunning" of the stop shoulders 74 and 78 the actuating knob 48 is not positively connected to the setting shaft 42 but only frictionally. The frictional connection results from the actuating knob 48 being fitted with force fit on the end of the setting shaft 42 projecting from the housing, the force fit being so dimensioned that although the torque transferable from the actuating knob 48 to the setting shaft 42 is sufficient to adjust the printing bands 20 the actuating knob 48 slips on the setting shaft 42 as soon as the printing bands 20 adjusted has reached one of its limit positions in which the leading tooth 50 in the adjustment direction comes to bear against the stop shoulder 74 or 78. The desired force fit can be achieved easiest by making the actuating knob 48 from an elastic material such as Vulkollan and forming the bore therein for receiving the setting shaft 42 with an internal diameter which is smaller than the external diameter of the end of the setting shaft 42 projecting from the housing. Because of the elasticity of the Vulkollan material the actuating knob 48 can easily be pushed onto the setting shaft 42 and can even be pressed over the clearly widened shaft end 80 illustrated in FIG. 1, which prevents the knob sliding off the shaft again. The connection between the actuating knob 48 and the setting shaft 42 is like a slip clutch which slips as soon as the resistance moment of a printing band 20 being adjusted counteracting the turning movement is greater than the torque transferable from the actuating knob 48 to the setting shaft 42. This occurs with certainty when the printing band 20 to be adjusted reaches one of its limit positions.

FIG. 3 shows another embodiment of a printing mechanism which in most details corresponds to the printing mechanism of FIG. 1; a difference is the nature of the mounting of the slit sleeve 29 in the printing mechanism housing. The individual slits are made as in the embodiment of FIG. 1, i.e. they are closed at the sleeve end on the left in the drawing but are open at the right sleeve end. For holding the sleeve 29 the housing half 13 is provided with an opening 82 which towards the housing interior merges into a bearing passage or bushing 84 for the sleeve 29. The end of the sleeve 29 comprises a collar 86 of enlarged diameter which prevents the sleeve 29 being pushed through the bearing bushing 84. At the other end the sleeve is mounted in a bearing passage 88 disposed in the housing half 15. The sleeve 29 has at this end a diameter reduced with respect to its center portion; the transistion to the greater diameter in the central portion is via a step 90 which on insertion of the sleeve 29 into the bearing bushing 88 acts as stop. For securing the sleeve 29 in the sleeve end projecting from the bearing bushing 88 a groove 92 is formed into which a securing ring 94 is inserted. As apparent from the sectional view of FIG. 4 the securing ring 94 comprises a slot 96 which makes it possible to expand the securing ring 94 for insertion into the groove 92. In this embodiment the sleeve 29 contributes to holding the two housing halves 13, 15 together in the upper part.

The end portion of the sleeve 29 passing through the bearing bushing or passage 88 also has compared with the rest of the sleeve a reduced internal diameter which is so dimensioned that it corresponds to the external diameter of the setting shaft 42. The setting shaft 42 is thus mounted in the sleeve 29.

Into the open ends of the slots 31, 33 and 35 on the right in the illustration of FIG. 3 spreading or expanding members 98, 100 and 102 are inserted which prevent the width of the slots 31, 33 and 35 changing during rotation of the setting shaft 42. Such a change could occur when due to dimensional inaccuracies resulting from production tolerances the sleeve segments lying on the periphery of the setting shaft 42 act with excessive pressure on the setting shaft 42 so that on rotation of the latter due to friction they are entrained to different extents in the particular direction of rotation. A change in the slot widths must however be prevented because otherwise the easy axial movement of the setting shaft 42 would be impaired. The teeth at the setting shaft 42 projecting through the slots could then possibly no longer freely move along the slots.

The spreading members or expanders 98, 100 and 102 can be formed as separate parts or can also be made integrally with the securing ring 94.

Due to the special mounting of the slit sleeves 28, 29 according to FIGS. 1 and 2 said sleeves can be made of plastic without impairing the resulting print quality, and this applies to all other parts of the printing mechanism (except for the helical spring 66).

As already mentioned all the other parts of the printing mechanism illustrated in FIG. 3 correspond to those of the printing mechanism of FIG. 1 and it would therefore be superfluous to describe them again.

It has already been explained in detail above how the detent finger 54 disposed on the sleeve 29 cooperates with the recesses 56 in the setting shaft 42. It is apparent in particular from this description that the intervals of the recesses 56 are equal to the width of the setting wheels 16 because when this dimensioning is observed the effect is achieved that on each engagement of the detent finger 54 in a recess 56 the teeth 36, 38 and 40 disposed on the setting shaft 42 engage in the recesses 46 of a setting wheel 16. Since the width of the setting wheels 16 also defines the width of the printing bands 20 led round them the intervals of the recesses 56 simultaneously define the width of the characters to be printed with the printing bands.

Apart from the detent mechanism becoming active on axial displacement of the setting shaft 42 and comprising the detent finger 54 and the recesses 56 the printing mechanism described can readily accommodate also wider setting wheels and accordingly wider printing bands for printing wider characters. The specific embodiment of the setting shaft described hereinafter serves to adapt the detent mechanism to different widths of the setting wheels and printing bands. This particular embodiment of the setting shaft is illustrated in a perspective fragmentary view in FIG. 5. This embodiment permits three different widths of type wheels and printing bands.

As shown by FIG. 5 the setting shaft 42 for receiving the detent recesses comprises three peripheral regions which lie between the positions of the teeth 36, 38, 40. In each of the three surfaces of the body thus formed recesses with different intervals are formed, of which in FIG. 5 the recesses 104 and 106 can be seen. The surface segments 107, 109 and 111 lie on a cylindrical surface so that the setting shaft 42 can be mounted on said surface segments. If the setting shaft 42 is inserted into the sleeve 28 or 29 in such a manner that the detent finger 54 cooperates with the recesses 104 detent positions result which are at a distance B1 apart and this means that setting wheels 16 with the width B1 can be used. If however the setting shaft is inserted into the sleeve 28 or 29 in such a manner that the recesses 106 cooperate with the detent finger 54 detent positions at a distance B2 apart result and this permits cooperation with setting wheels of width B2. On the rear surface in FIG. 5 of the setting shaft recesses of a third width are disposed which in corresponding manner permit cooperation with setting wheels of said third width.

When using the setting shaft 42 illustrated in FIG. 5 the printing mechanism is substantially more versatile as regards the possible width of the characters to be printed. In the example of embodiment described on the setting shaft 42 three peripheral regions are provided for receiving detent recesses. It is of course also possible to provide on the setting shaft four peripheral regions for receiving detent recesses; however, four slots must then be formed in the sleeve 28 or 29 through which extend for example two teeth disposed at diametrically opposite edges of the quadrilateral for driving the setting wheels 16. The setting shaft with four peripheral regions can be inserted in four different positions into the sleeve 28 or 29, in each case the recesses formed in one peripheral region cooperating with the detent finger.

The printing mechanism described is suitable for installation in hand labeling devices with the aid of which self-adhering labels adhering to a carrier tape can be imprinted and applied to articles. FIG. 6 shows diagrammatically such a hand labeling device. It comprises a grip 108 disposed at the rear end of a housing 110. At the top of the housing there is a well 112 serving to receive a supply roll 114 of the carrier tape carrying the self-adhesive labels. The carrier tape is fed in the device from the supply roll 114 downwardly in the direction towards the front edge 115. It is guided over a printing platen 118 at the front edge of which it is deflected in an acute angle so that the self-adhesive labels are detached from the carrier tape and reach a position in which they can be applied to articles. Such a device and its use are described for example in DE-OS No. 3,017,843.

Beneath the grip 108 there is an operating lever 120 which is rotatably mounted about a shaft 113 and with the aid of which all the operations taking place in the device, such as the feeding of the carrier tape and the printing, can be carried out. To actuate the device the operating lever 120 is pulled against the force of a spring 121 against the grip 108 and then released again. The printing mechanism 10 attached in the front region of the housing 110 to an extension of the operating lever 120 moves, when the latter is pulled, in the direction of the arrow 122 against the printing platen 118; at the same time the printing types disposed in the printing position are wetted with ink by means of an inking device which is not illustrated. The self-adhesive label disposed on the printing platen 118 is thus imprinted by the impinging of the printing mechanism.

As apparent from FIG. 6 the actuating knob 48 projects laterally at the housing 110 and in the housing side wall visible in FIG. 6 a cutout 124 is formed which permits movement of the printing mechanism 10 in the direction of the arrow 122 without the printing mechanism striking the housing wall. In FIG. 7 the housing wall visible in FIG. 6 can be seen as housing wall **110*a* whilst the rear housing wall in the illustration is denoted by the reference numeral 110*b*. If the printing bands 20 of the printing mechanism 10 are to be adjusted with the aid of the actuating knob 48 in such a manner that certain characters are printed on the self-adhesive label disposed on the printing platen 118, the adjusting shaft 42 is brought successively into engagement with the individual setting wheels 16 and the setting wheel 16 in engagement with the setting shaft 42 can then be turned to adjust the printing bands 20. In FIGS. 7 and 8 two different positions of the setting shaft 42 are shown; in the position of FIG. 7 the second printing band 20 from the left and in the position of FIG. 8 the sixth printing band 20 from the left can be adjusted. To adjust the printing bands 20 at the extreme right the setting shaft 42 must be extended a long way out of the printing mechanism housing so that the actuating knob 48 and the cap 64 project to a great extent from the housing wall 110*a*. However, when using the hand labeling device it is undesirable to have parts projecting from the device with which the operator can strike other objects or be impeded. Such striking or impeding can result in damage to the printing mechanism. Although the operator is advised to insert the setting shaft 42 completely into the sleeve 28 again by pressing the actuating knob this instruction is not always carried out. In the device illustrated in FIGS. 6 to 8 provisions are made for preventing the printing mechanism from being lowered for as long as the setting shaft 42 is extended a long way out of the sleeve 28**.

The cutout shown in FIG. 6 in the housing wall 110*a* is so dimensioned that to adjust the setting wheels 16 in the inoperative position of the printing mechanism 10 the setting shaft 42 with the cap 64 can be pulled laterally out of the housing 110 and the printing mechanism 10 in the inserted condition of the setting shaft 42 can be lowered through the distance necessary to imprint a self-adhesive label on the printing platen 18 without the setting shaft 42 or the cap 64 coming into contact with the housing wall 110*a*. If the setting shaft 42 is displaced in the sleeve 28 in the view of FIG. 7 to the right to such an extent that its teeth come into engagement with the second setting wheel 16 from the left, when the printing mechanism 10 is lowered against the printing platen 118 the inclined surface of the cap 64 strikes the housing wall 110*a* so that on further lowering of the printing mechanism 10 a return force must be exerted on the setting shaft 42 which displaces said shaft into the position completely inserted into the sleeve 28. Thus, if the setting shaft 42 was not completely inserted at the start of the printing operation by the cooperation of the upper end 126 of the housing wall 110*a* and the cap 64 it is automatically returned. As apparent from FIG. 7 the upper end 126 of the housing wall 110*a* can be beveled so that the cap 64 is not damaged and transmission of the return force is facilitated.

If the setting shaft 42 is extracted further from the sleeve 28 than illustrated in FIG. 8, where the teeth of the setting shaft 42 are in engagement with the sixth setting wheel 16 from the right, the labeling device can no longer be operated because when an attempt is made to lower the printing mechanism 10 against the printing platen 118 a pin 128 parallel to the setting shaft 42 and fixedly connected to the cap 64 strikes against the upper end 126 of the housing wall 110*a*. Thus, if the operator has forgotten to push the setting shaft 42 back in again after the extraction and execution of the adjusting operations he is immediately reminded of this when he attempts to operate the labeling device by pulling the operating lever 120. Due to the striking of the pin 128 on the housing wall 110*a* the device is practically blocked and can only be operated again after the setting shaft 42 has been pushed in.

The pin 128 disposed on the cap 64 is displaced on displacement of the setting shaft 42 in a passage 130 in the housing half 14. Behind said passage 130 in the printing mechanism housing the helical spring 66 described in conjunction with FIG. 1 is located and its internal diameter is so large that it can readily receive the pin 128 without the latter obstructing the deformation of the helical spring on adjustment of the setting wheels 16.

As apparent from FIG. 2 the pin 128 is approximately T-shaped in cross-section which apart from saving material improves the stiffness of the pin 128 in the direction in which it is stressed when it strikes against the end 126 of the housing wall 110*a* when an attempt is made to actuate the labeling device when the setting shaft is extended. Other cross-sectional forms which provide improved stability may also be used.

The further development of the setting shaft 42 and the sleeve 28, 29 surrounding it described in conjunction with FIGS. 1, 2 and 3 and their mounting and axial detent mechanism 54, 56 can readily be used also in printing mechanisms in which the printing types are not disposed on printing bands 20 led round the setting wheels 16 and the deflection edge 18 spaced therefrom but arranged directly at the periphery of the setting wheels as in the case for example in the printing mechanism according to DE-GM No. 1,961,550 mentioned above.

I claim:

1. Printing mechanism comprising a sleeve including an axially immovable detent element and a plurality of setting wheels each having a hub with a plurality of radial recesses and mounted coaxially on said sleeve, and type carriers carrying printing types in a drive connection with said setting wheels, a setting shaft disposed rotatably and axially displaceably in the sleeve, a slot extending in the axial direction formed in the sleeve, and a tooth on the setting shaft extending through said slot and engaging said radial recesses, and a detent means with detent recesses on the peripheral surface of the setting shaft into which, for fixing axial detent positions of the setting shaft, said axially immovable detent element engages, said detent recesses (56;104,106) being arranged in a plurality of axial rows with each row having a different detent spacing, said detent element (54) being movable into any detent recess in one of said rows.

2. Printing mechanism according to claim 1, characterized in that the detent element (54) is a detent finger which is integrally formed on the sleeve (28; 29) and which projects radially inwardly at the sleeve inner surface and engages in the detent recesses (56; 104, 106) associated therewith in the setting shaft (42; 43).

3. Printing mechanism according to claim 1 or 2, characterized in that in the sleeve (28; 29) three axially extending slots (30, 32, 34; 31, 33, 35) are disposed at equal angular intervals through which three teeth (36, 38, 40) disposed on the setting shaft (42; 43) engage in the radial recesses (46) in the hub region of the setting wheels (16), and that the axial rows of the detent recesses (56; 104, 106) are formed in the peripheral surface regions of the setting shaft (42; 43) which lie between the positions of the teeth (36, 38, 40).

4. Printing mechanism according to claim 3, characterized in that the slots (30, 32, 34; 31, 33, 35) are open in the axial direction at one end of the sleeve (28; 29).

* * * * *